US012421634B2

(12) United States Patent
Lin et al.

(10) Patent No.: US 12,421,634 B2
(45) Date of Patent: Sep. 23, 2025

(54) ANTIMICROBIAL KNITTED FABRIC AND A METHOD OF MANUFACTURING THEREOF

(71) Applicant: INNOTIER LIMITED, Hong Kong (CN)

(72) Inventors: Jack Lin, Jinjiang (CN); Hiu Ying Lam, Hong Kong (CN); Hei Man LAM, Jinjiang (CN)

( * ) Notice: Subject to any disclaimer, the term of this patent is extended or adjusted under 35 U.S.C. 154(b) by 0 days.

(21) Appl. No.: 18/711,152

(22) PCT Filed: Nov. 17, 2022

(86) PCT No.: PCT/CN2022/132647

§ 371 (c)(1),
(2) Date: May 21, 2024

(87) PCT Pub. No.: WO2023/088390

PCT Pub. Date: May 25, 2023

(65) Prior Publication Data

US 2025/0011983 A1 Jan. 9, 2025

(30) Foreign Application Priority Data

Nov. 20, 2021 (CN) ..... 202111380820.4
Nov. 24, 2021 (CN) ..... 202111404436.3

(51) Int. Cl.
*D04B 1/12* (2006.01)

(52) U.S. Cl.
CPC ..... *D04B 1/12* (2013.01); *D10B 2401/13* (2013.01); *D10B 2403/02* (2013.01)

(58) Field of Classification Search
CPC ..... D04B 1/12; D04B 1/102; D04B 1/123; D04B 1/265; D04B 7/26; D04B 9/38
See application file for complete search history.

(56) References Cited

U.S. PATENT DOCUMENTS 4,984,570 A * 1/1991 Langen ..... A61F 13/01008 602/44
5,053,021 A * 10/1991 Feibus ..... A61M 27/00 428/913

(Continued)

FOREIGN PATENT DOCUMENTS

CN 101144221 A 3/2008
CN 102864564 A 1/2013

(Continued)

OTHER PUBLICATIONS

National Intellectual Property Administration, People's Republic of China, International Search Report PCT/CN2022/132647, Jan. 28, 2023, Beijing, China.

(Continued)

*Primary Examiner* — Danny Worrell
(74) *Attorney, Agent, or Firm* — NCC-IP; Nevin Stuart Carmichael

(57) ABSTRACT

The invention relates to an antimicrobial knitted fabric, comprising at least one first knitted layer comprises one or more first yarns comprising a metallic material, wherein the first yarns are arranged to provide a plurality of free-floating loop structures at a surface of the first knitted layer thereby increasing surface area of the metallic material-comprising first yarns to enhance antimicrobial effect of the fabric.

18 Claims, 5 Drawing Sheets

(56) References Cited

U.S. PATENT DOCUMENTS

| | | | | | |
|---|---|---|---|---|---|
| 5,416,929 | A * | 5/1995 | Braunstein | A41B 9/004 | 450/156 |
| 5,807,295 | A * | 9/1998 | Hutcheon | D04B 21/14 | 602/8 |
| 6,158,253 | A * | 12/2000 | Svoboda | A61F 13/08 | 66/178 R |
| 7,926,307 | B1 * | 4/2011 | Williams | D04B 1/02 | 66/194 |
| 8,460,698 | B2 * | 6/2013 | MacMeccan | A61F 13/0213 | 424/445 |
| 2003/0106346 | A1 * | 6/2003 | Matsumoto | D04B 21/10 | 66/195 |
| 2004/0078915 | A1 * | 4/2004 | Hockey-Smith | D02G 3/449 | 15/228 |
| 2004/0099019 | A1 * | 5/2004 | Sasser | A44B 18/0034 | 66/195 |
| 2006/0013613 | A1 * | 1/2006 | Iwasaki | A01M 1/2055 | 399/122 |
| 2007/0144221 | A1 * | 6/2007 | Sytz | D04B 1/18 | 66/171 |
| 2007/0281154 | A1 * | 12/2007 | Graichen | D04B 21/12 | 428/364 |
| 2009/0326565 | A1 * | 12/2009 | Trabucco | D04B 21/12 | 606/151 |
| 2010/0030178 | A1 * | 2/2010 | MacMeccan | A61F 13/0213 | 604/378 |
| 2010/0168634 | A1 * | 7/2010 | Leeming | A61F 13/069 | 602/76 |
| 2012/0177904 | A1 * | 7/2012 | Gehring, Jr. | D04B 21/10 | 428/220 |
| 2013/0317623 | A1 * | 11/2013 | Trabucco | D04B 21/12 | 623/23.72 |
| 2017/0350043 | A1 * | 12/2017 | Lai | D02G 3/04 | |
| 2020/0196700 | A1 * | 6/2020 | Tamm | A43B 23/0205 | |
| 2020/0206037 | A1 * | 7/2020 | Rezvov | A61F 13/08 | |
| 2022/0074091 | A1 * | 3/2022 | Poegl | D04B 7/28 | |
| 2022/0151341 | A1 * | 5/2022 | Filipescu | D04B 1/10 | |
| 2022/0162782 | A1 * | 5/2022 | Kalantari | D02G 3/443 | |
| 2022/0233895 | A1 * | 7/2022 | Matsui | A62B 23/025 | |
| 2023/0122615 | A1 * | 4/2023 | Chen | D04B 15/32 | 66/202 |
| 2025/0011983 | A1 * | 1/2025 | Lin | D04B 1/12 | |

FOREIGN PATENT DOCUMENTS

| | | | | | |
|---|---|---|---|---|---|
| CN | 203300454 | U | | 9/2013 | |
| CN | 103469456 | A | * | 12/2013 | |
| CN | 107503030 | A | | 12/2017 | |
| CN | 206858755 | U | | 1/2018 | |
| CN | 207016944 | U | | 2/2018 | |
| CN | 208917410 | U | | 5/2019 | |
| CN | 209699992 | U | | 11/2019 | |
| CN | 110670220 | A | | 1/2020 | |
| CN | 210082592 | U | | 2/2020 | |
| CN | 110983585 | A | | 4/2020 | |
| CN | 210856512 | U | | 6/2020 | |
| CN | 211620731 | U | | 10/2020 | |
| CN | 113172956 | A | | 7/2021 | |
| CN | 214458626 | U | | 10/2021 | |
| DE | 202006017511 | U1 | * | 4/2007 | D04B 1/14 |
| EP | 1788130 | A1 | * | 5/2007 | D04B 1/14 |
| EP | 2208816 | A | | 7/2010 | |
| FR | 2772240 | A1 | * | 6/1999 | A41B 3/10 |
| JP | H1072704 | A | | 3/1998 | |
| JP | 2009120980 | A | | 6/2021 | |
| PL | 238195 | B1 | * | 7/2021 | |

OTHER PUBLICATIONS

English Translation of Chinese Patent application 107503030, www.Espacenet.com, European Patent Office, Munich, Jun. 3, 2024 (https://worldwide.espacenet.com/patent/search/family/060692624/publication/CN107503030A?q=CN107503030A).

English Translation of Chinese Patent application 209699992, www.Espacenet.com, European Patent Office, Munich, Jun. 3, 2024 (https://worldwide.espacenet.com/patent/search/family/068645309/publication/CN209699992U?q=CN209699992U).

English Translation of Chinese Patent application 101144221, www.Espacenet.com, European Patent Office, Munich, Jun. 3, 2024 (https://worldwide.espacenet.com/patent/search/family/039206941/publication/CN101144221A?q=CN101144221A).

English Translation of Chinese Patent application 110983585, www.Espacenet.com, European Patent Office, Munich, Jun. 3, 2024 (https://worldwide.espacenet.com/patent/search/family/070090131/publication/CN110983585A?q=CN110983585A).

English Translation of Chinese Patent application 113172956, www.Espacenet.com, European Patent Office, Munich, Jun. 3, 2024 (https://worldwide.espacenet.com/patent/search/family/076924184/publication/CN113172956A?q=CN113172956A).

English Translation of Japanese Patent application H1072704, www.Espacenet.com, European Patent Office, Munich, Jun. 3, 2024 (https://worldwide.espacenet.com/patent/search/family/016824485/publication/JPH1072704A?q=JPH1072704A).

English Translation of Chinese Patent application 207016944, www.Espacenet.com, European Patent Office, Munich, Jun. 3, 2024 (https://worldwide.espacenet.com/patent/search/family/061481575/publication/CN207016944U?q=CN207016944U ).

English Translation of Chinese Patent application 102864564, www.Espacenet.com, European Patent Office, Munich, Jun. 3, 2024 (https://worldwide.espacenet.com/patent/search/family/047443682/publication/CN102864564A?q=CN102864564A).

English Translation of Chinese Patent application 110670220, www.Espacenet.com, European Patent Office, Munich, Jun. 3, 2024 (https://worldwide.espacenet.com/patent/search/family/069086307/publication/CN110670220A?q=CN110670220A).

English Translation of Chinese Patent application 208917410, www.Espacenet.com, European Patent Office, Munich, Jun. 3, 2024 (https://worldwide.espacenet.com/patent/search/family/066706560/publication/CN208917410U?q=CN208917410U).

English Translation of Chinese Patent application 210082592, www.Espacenet.com, European Patent Office, Munich, Jun. 3, 2024 (https://worldwide.espacenet.com/patent/search/family/069480337/publication/CN210082592U?q=CN210082592U).

English Translation of Chinese Patent application 211620731, www.Espacenet.com, European Patent Office, Munich, Jun. 3, 2024 (https://worldwide.espacenet.com/patent/search/family/072623617/publication/CN211620731U?q=CN211620731U).

English Translation of Chinese Patent application 206858755, www.Espacenet.com, European Patent Office, Munich, Jun. 3, 2024 (https://worldwide.espacenet.com/patent/search/family/060823256/publication/CN206858755U?q=CN206858755U).

* cited by examiner

| | Course 1 | Course 2 | Course 3 | Course 4 | Course 5 | Course 6 |
|---|---|---|---|---|---|---|
| Dial needle | U<br>- | -<br>- | V<br>V | -<br>U | -<br>- | V<br>V |
| Cylinder needle | -<br>∩ | Λ<br>Λ | -<br>- | ∩<br>- | Λ<br>Λ | -<br>- |

FIG. 4

ANTIMICROBIAL KNITTED FABRIC AND A METHOD OF MANUFACTURING THEREOF

FIELD OF THE INVENTION

The invention relates to a knitted fabric, and particularly but not exclusively, to an antimicrobial knitted fabric.

BACKGROUND OF THE INVENTION

A variety of specialty textiles have been developed for various specialized functions and purposes. Among them, there have been growing interests on the development and application of antimicrobial textiles, especially with the outbreak of COVID-19 which surges the demand of protective clothing worldwide. According to a report from *Antimicrobial Textiles Market,* 2021-2028, the market of global antimicrobial textiles is projected to grow from about USD 9.45 billion in 2021 to about USD 13.63 billion by 2028, with a compound annual growth rate (CAGR) of 5.2% during the forecast period.

The term "antimicrobial" can generally be defined as "destroying or inhibiting the growth of microorganisms, and especially, pathogenic microorganisms". Microorganisms may include, but are not limited to, bacteria, viruses, protozoans, and fungi, like mold and mildew. Among the various antimicrobial products, antimicrobial textiles demonstrate growing applications in facilities such as hospitals, medical centers and laboratories, nursery care and/or elderly care facilities, etc. Antimicrobial textiles are functionally active textiles which may eliminate or inhibit growth of microorganisms, and therefore, show good potential in reducing transmission of infection in medical and healthcare environments. For example, antimicrobial fabrics can be used in protective person equipment such as protective clothing, as well as in furniture such as beddings, furniture covers and curtains, etc. Antimicrobial fabrics may also be used in the manufacturing of uniforms such as uniforms for healthcare professionals and for military services. The COVID-19 pandemic further raises the demand of antimicrobial fabrics for the production of protective gloves, face coverings or masks, and gowns, etc. and particularly, face masks are becoming more widely used by the general public to control, reduce or prevent spreading of respiratory viruses, or at least to serve as precautionary measures. It was declared in October 2020 that around 93% of U.S. adults said that they always, often, or sometimes wear a face covering or mask while leaving home. In view of the growing awareness on health and hygiene, there exists a need for new antimicrobial fabrics or textiles that are effective in destroying or inhibiting growth of harmful microorganisms such as bacteria and viruses, and at the same time, providing comfortability and usability for the users.

Objects of the Invention

An object of the present invention is to provide a novel antimicrobial textile or fabric material.

Another object of the present invention is to mitigate or obviate to some degree one or more problems associated with known antimicrobial textiles or fabrics, or at least to provide a useful alternative.

The above objects are met by the combination of features of the main claims. The dependent claims disclose further advantageous embodiments of the invention.

One skilled in the art will derive from the following description other objects of the invention. Therefore, the foregoing statements of object are not exhaustive and serve merely to illustrate some of the many objects of the present invention.

SUMMARY OF THE INVENTION

In a first main aspect, the invention provides an antimicrobial knitted fabric. The antimicrobial knitted fabric comprises at least one first knitted layer comprises one or more first yarns comprising a metallic material, wherein the first yarns are arranged to provide a plurality of free-floating loop structures at a surface of the first knitted layer thereby increasing surface area of the metallic material-comprising first yarns to enhance antimicrobial effect of the fabric.

In a second main aspect, the invention provides a method of manufacturing the antimicrobial knitted fabric of the first main aspect. The method comprises a step of weft knitting according to a weft knitted pattern comprising a first course comprising a tuck stitch, two float stitches, and a tuck stitch in sequence; a second course comprising two knit stitches and two float stitches in sequence; a third course comprising two float stitches and two knit stitches in sequence; a fourth course comprising a float stitch, two tuck stitches and one float stitch in sequence; a fifth course comprising two knit stitches and two float stitches in sequence; and a sixth course comprising two float stitches and two knit stitches in sequence.

The summary of the invention does not necessarily disclose all the features essential for defining the invention; the invention may reside in a sub-combination of the disclosed features.

BRIEF DESCRIPTION OF THE DRAWINGS

The foregoing and further features of the present invention will be apparent from the following description of preferred embodiments which are provided by way of example only in connection with the accompanying figures, of which:

FIG. 4 shows an embodied pattern of weft knitting according to the present invention.

DESCRIPTION OF PREFERRED EMBODIMENTS

Figure 1:
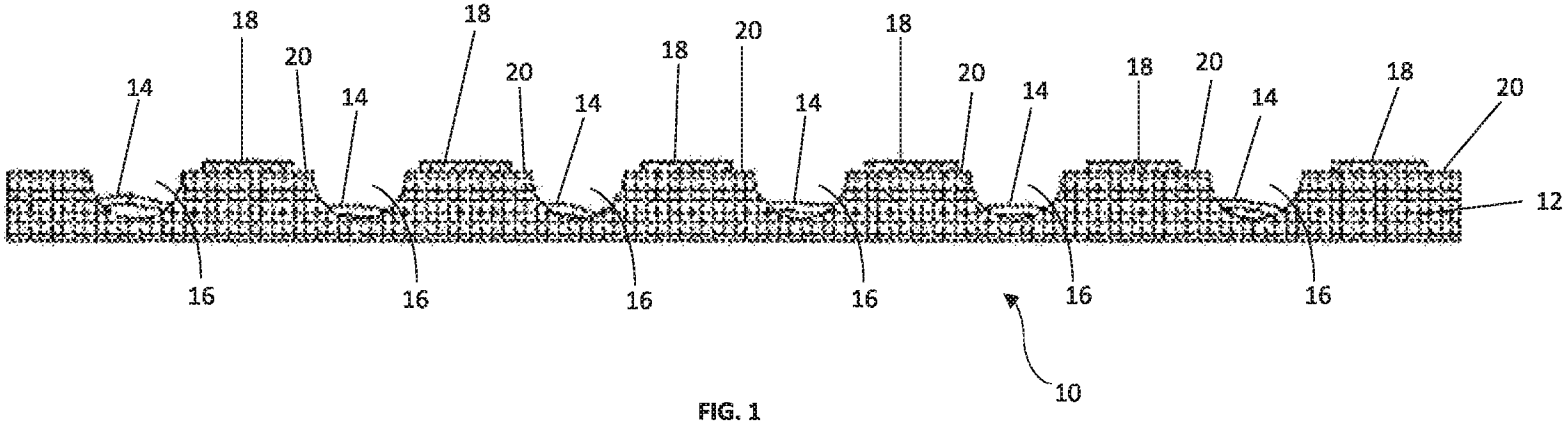
FIG. 1 is a schematic diagram showing an embodiment of the antimicrobial knitted fabric according to the present invention.

The following description is of preferred embodiments by way of example only and without limitation to the combination of features necessary for carrying the invention into effect.

Reference in this specification to "one embodiment" or "an embodiment" means that a particular feature, structure, or characteristic described in connection with the embodiment is included in at least one embodiment of the invention. The appearances of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not other embodiments.

In the claims hereof, any element expressed as a means for performing a specified function is intended to encompass any way of performing that function. The invention as defined by such claims resides in the fact that the functionalities provided by the various recited means are combined and brought together in the manner which the claims call for. It is thus regarded that any means that can provide those functionalities are equivalent to those shown herein.

The present invention relates to a knitted textile or fabric and particularly, but not exclusively, an antimicrobial knitted textile or fabric capable of reducing, inhibiting growth of or eliminating harmful microorganisms such as, but are not limited to, bacteria, viruses and fungi, and at the same time, providing an improved comfortability and usability for the users. The antimicrobial knitted fabric, which is preferably manufactured by weft-knitting, comprises metallic silver-comprising yarns arranged to provide free-floating loop structures at the surface of a knitted layer of the fabric. The free-floating loop structures are beneficial in increasing surface area of the silver yarns at the fabric to thereby enhance the contact antimicrobial effect of the fabric against various microbes. The silver metal atoms of the metallic silver yarns can be oxidized to form silver ions which are known to possess powerful anti-microbial abilities. Particularly, the positively charged silver ions are electrostatically attracted to the negatively charged bacteria, interfering or altering structure of the bacterial DNA and thus inhibiting replication of the bacteria. Metallic silver has also been proven to exhibit inhibiting activity against a broad-spectrum of pathogens including bacteria, viruses, fungi or the like upon contact. The knitted fabric of the present invention is thus capable of protecting the user or wearer from external contaminants by its self-disinfecting, anti-viral and anti-microbial effects due to the high surface area to volume ratio of metallic silver yarns. The antimicrobial efficiency can be further improved by increasing contact surface area of the silver yarns with the pathogens, such as by arranging the free-floating loop structures of the silver yarns at respective plurality of recesses comprising the silver yarns, and/or by forming protrusions comprising the silver yarns at the surface of the knitted layer. The resulting knitted fabric demonstrates highly effective antimicrobial effect and, at the same time, provides superior breathability, i.e. moisture vapor transmission, stretchability and hand-feel to the knitted material. It is demonstrated that the antimicrobial efficiency of the knitted fabric can be maintained after about 100-200 times of washing. The high content of silver yarns at the resulting fabric offers further benefits in facilitating heat conduction to help regulation of body temperature and in inhibiting undesirable odors caused by microbials. The free-floating loop structures of the silver yarns at recesses of the fabric layer and/or the silver yarns-comprising protrusions at the surface of the fabric layer may further be arranged in specific knit patterns to offer aesthetic, decorative features to the knitted fabric.

Some common terminologies relating to the knitting techniques of the present invention are discussed below:

Weft-knitting: A knitting technique using a continuous thread or yarn to form horizontal parallel courses of loops or stitches in the fabric. Yarn of a weft-knitted fabric runs horizontally, from side to side, across the width of the fabric. The courses of yarn are joined to each other by interlocking loops in which a short loop of one course of yarn is wrapped over another course. Weft-knitted fabrics are known to demonstrate good elasticity.

Course: A series of loops or stitches which are connected horizontally and continuously to form a horizontal row at the fabric.

Wales: A series of loops or stitches which intermesh vertically to form a vertical column at the fabric.

Stitch or loop: The smallest stable unit of a knitted fabric consisting of a yarn loop held together by being intermeshed or interlocked with another stitch or loop.

Knit stitch, knit loop, plain stitch or plain loop: A knit stitch or loop is also commonly referred to as a plain stitch or loop. A knit stitch is produced when a needle receives a new loop and knocks over the old loop that it held from the previous knitting cycle. A knit stitch is schematically represented by the symbol "“”" or "“”" in the context of the present invention.

Tuck stitch or tuck loop: a tuck stitch is produced when a needle holding its loop also receives a new loop, and the new loop is not intermeshing through the old loop. A tuck stitch resembles an inverted V or U-shape as appeared at the fabric. A tuck stitch is usually wider and more porous than a knit stitch. A fabric formed by tuck stitches is generally thicker than one formed by knit stitches due to yarn accumulation at the tucking places. A tuck stitch is schematically represented by the symbol "∪" or "∩" in the context of the present invention.

Float stitch, float loop, miss stitch or miss loop: A float stitch or loop is also commonly referred to as a miss stitch or loop. A float stitch is produced when a needle holding an old loop fails to receive the new yarn that passes. A float stitch shows the missed new yarn floating freely on the reverse side of the held loop. A float stitch is usually narrower than other types of stitch, as the wale is drawn closer together by the float stitch which reduces elasticity along the width which improves stability of the fabric. A fabric formed by float stitches is generally thinner than one formed by tuck or knit stitches as there is no yarn accumulation. A float stitch is schematically represented by the symbol "-" in the context of the present invention.

Referring to FIG. 1, shown is an embodiment of a knitted fabric 10 according to the present invention. The knitted fabric 10 is preferably a fabric formed from weft-knitting, although other known knitting techniques, which do not depart from the inventive concept of the present invention, shall also be encompassed by the present invention.

Preferably, the knitted fabric 10 comprises at least one first knitted layer 12 having one or more first yarns. The first yarns preferably comprise a metallic material, which can be one or more metals, metal alloys and/or metal compounds. In one embodiment, the metallic material may comprise one or more of metallic silver, copper, gold, zinc, gallium, titanium, tin, cobalt, lead, nickel, strontium, zirconium, molybdenum, alloy thereof and/or compound thereof, due to their antimicrobial activities. In one preferred embodiment, the first yarns comprise silver metal, with the first knitted layer 12 comprising a content of silver metal at about 5% to about 50%, and more preferably, at about 6% to about 30%.

In one embodiment, the silver metal-comprising first yarns comprise silver metal yarns of 40 denier (40 D). In one further embodiment, the silver metal-comprising first yarns comprises composite or conjugate yarns forming from silver metal-comprising yarns, such as the 40 D silver yarns with one or more other yarns or fibers, such as nylon fibers and/or spandex fibres, for example, spandex fibres of 30 denier (30 D OP).

Preferably, the silver metal-comprising first yarns are arranged to provide a plurality of free-floating loop structures 14 at a surface of the first knitted layer 12. The term "free-floating" of the loop structure can be defined in having "a portion such as a middle portion of the loop structure not being supported, connected or attached to any other structure". This is in contrast to the two distal, non-free-floating ends of the loop structure which are connected or attached to other structure or structures such as the adjacent loops or stitches. In one embodiment, the free-floating loop structures 14 can be formed by one or more "float stitches" from weft-knitting the silver metal-comprising first yarns.

In one preferred embodiment, the loop structures 14 of the silver metal-comprising first yarns cover about 50% to about 70% of the first knitted layer 12.

As silver metal has been proven to exhibit antimicrobial activity against a broad-spectrum of pathogens such as bacteria and viruses upon contact, the silver metal-comprising first yarns arranged in free-floating loop structures 14 further enhances the antimicrobial efficiency of the knitted fabric 10 by significantly increasing the surface area to volume ratio of the silver yarns, and thus, contactable surface area of the silver yarns by the pathogens.

In one embodiment, a plurality of recesses 16 can be arranged at the first knitted layer 12, and preferably, at the surface of the first knitted layer 12 for accommodating the plurality of loop structures 14 of the silver yarns. More preferably, each of the plurality of recesses 16 is arranged to accommodate a respective one of the loop structures 14, as shown in FIG. 1. In one embodiment, the plurality of recesses 16 may form an array of hole structures on the surface of the first knitted layer 12, with hole structures being porous, that is, comprise one or more air passageways or channels in or through the first knitted layer 12.

In one embodiment, the recesses 16 can be arranged to form an array of elongated structures such as row structures on the surface of the first knitted layer 12 accommodating a plurality of loop structures 14 therein. In one embodiment, the recesses 16 may also comprise the silver metal-comprising first yarns.

In one embodiment, a plurality of protrusions 18 can be arranged at the first knitted layer 12, and preferably, at the surface of the first knitted layer 12. The protrusions 18 are preferably extending away or protruding from one or more planar regions 20 of the first knitted layer 12. The plurality of protrusions 18 may preferably comprise the metallic material-comprising first yarns such as the silver metal-comprising first yarns. In one preferred embodiment, the plurality of recesses 16 and the plurality of protrusions 18 are alternately arranged at the first knitted layer 12, as shown in FIG. 1. In one further embodiment, the protrusions 18 and/or the recesses 16 can be arranged in specific patterns to provide aesthetic decorative features such as three-dimensional features to the knitted fabric 10. The protrusions 18 and/or the recesses 16 may further be arranged to provide a certain hand-feel such as a textured, airy hand-feel to the resulting knitted fabric 10. In one embodiment, the protrusions 18 can be formed by one or more "tuck stitches" during weft-knitting of the first knitted layer 12.

The contact surface area of the silver yarns and thus the antimicrobial activity of the fabric 10 can be further enhanced by arranging the free-floating loop structures 14 at the respective recesses 16 and/or protrusions 18 of the knitted fabric 10. The resulting knitted fabric 10 demonstrates highly effective antimicrobial effect. The porous recesses 16 further allow superior breathability, i.e. moisture vapor transmission, and stretchability to the knitted fabric 10. Furthermore, the antimicrobial efficiency of the knitted fabric is found to be maintained after about 100-200 times of washing.

In one embodiment, the first yarns may comprise metallic silver coatings such as silver metal coatings on core fibers. Preferably, the metallic silver-coated yarns may comprise 99.9% pure silver metal coated polymeric core fibres, such as but are not limited to, polyamide core fibres or nylon core fibres. In another embodiment, the first yarns may comprise metallic silver with charged silver ions incorporated in polymeric materials, with the silver ions-embedded polymeric materials subsequently being extruded into fiber forms. Yet a person skilled in the art may appreciate that other techniques in forming metalized fibers or yarns may also be encompassed by the present invention, as long as the variations do not depart from the present inventive concept.

Figure 2:
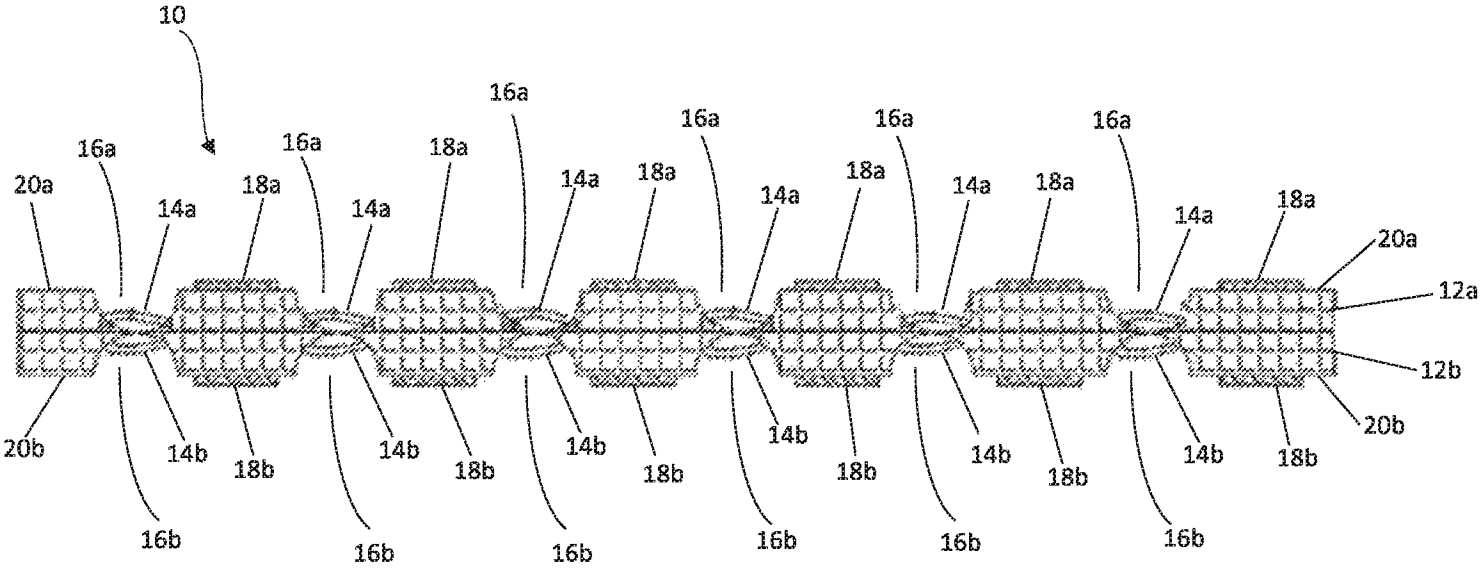
FIG. 2 is a schematic diagram showing a second embodiment of the antimicrobial knitted fabric according to the present invention.

Referring to FIG. 2, shown is another embodiment of the knitted fabric 10 of the present invention. In this embodiment, the first knitted layer 12 may comprises two oppositely arranged first knitted layers 12*a* and 12*b*, with the plurality of recesses 16*a* and 16*b* of the respective first knitted layers 12*a*, 12*b* facing away from one another. Preferably, the two first knitted layers 12*a* and 12*b* are in an interlocked or intermeshed arrangement. In one embodiment, the plurality of recesses 16*a* and 16*b* of the two first knitted layers 12*a* and 12*b* are aligned to form two opposing arrays of hole structures, although it is possible that the plurality of recesses 16*a* of the first knitted layer 12*a* may be arranged to off-set from the plurality of recesses 16*b* of the second knitted layer 12*b* thus forming two sets of alternating holes at the two opposing sides of the knitted fabric 10. In one embodiment, the hole structures of the aligned recesses 16*a* and 16*b* of the two first knitted layers 12*a* and 12*b* are porous, that is, the recesses 16*a* and 16*b* are arranged to form one or more air passageways connecting the two opposing sides of the first knitted layers 12*a* and 12*b*.

Similar to the embodiment of FIG. 1, protrusions 18*a* and 18*b* comprising the silver metal-comprising first yarns may preferably be arranged at the respective surfaces of the two first knitted layers 12*a* and 12*b*. Again, the protrusions 18*a*, 18*b* are preferably extending away from one or more planar regions 20*a* and 20*b* of the respective first knitted layers 12*a* and 12*b*. In one embodiment, the recesses 16*a* and the protrusions 18*a* of the first knitted layer 12*a*, and the recesses 16*b* and the protrusions 18*b* of the first knitted layer 12*b* are alternately arranged, as shown in FIG. 2. By having two first knitted layers 12*a* and 12*b*, and particularly, by arranging the silver yarns as free-floating loop structures 14*a* and 14*b* at the respective recesses 16*a* and 16*b* and/or protrusions 18*a* and 18*b* at the surface of the respective knitted layers 12*a*, 12*b*, contact surface area of the silver yarns can be further enhanced and thus, enhancing the antimicrobial activity. The oppositely faced recesses 16*a* and 16*b* may improve breathability and stretchability of the knitted material. The antimicrobial efficiency of the knitted fabric is found to be maintained after about 100-200 times of washing.

Figure 3:
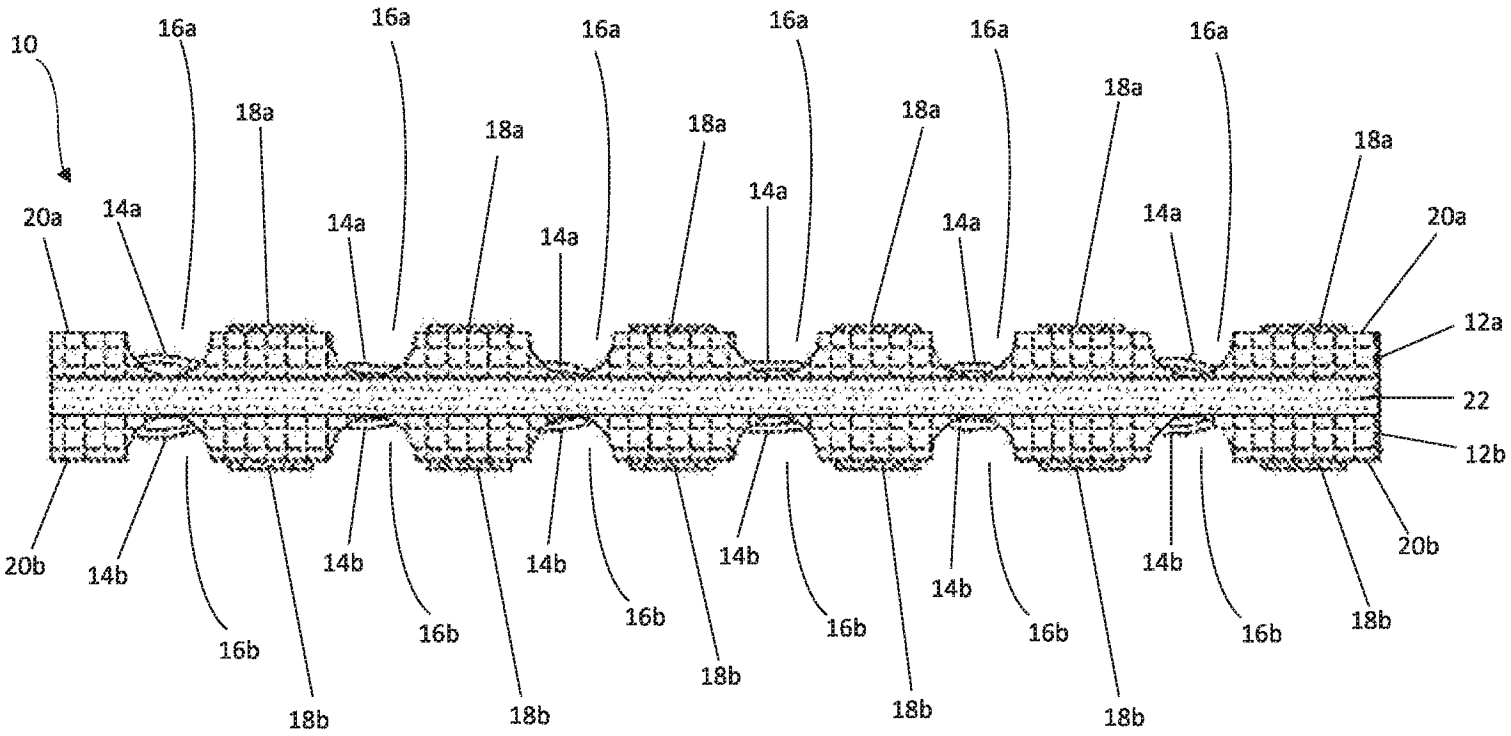
FIG. 3 is a schematic diagram showing a third embodiment of the antimicrobial knitted fabric according to the present invention.

In one further embodiment, the two first knitted layers 12*a* and 12*b* are connected via a middle, second layer 22 to form a sandwiched structure, as shown in FIG. 3. The second layer 22 is preferably a second knitted layer, although it can be materials formed from any known techniques such as being a knitted layer, a woven layer, a non-woven layer, and/or a foam layer, etc. In one embodiment, the second layer 22 can be connected or by any means, attached to the first knitted layers 12*a* and 12*b* such as sewing, binding, adhering or gluing for example, by heat melt adhesive, etc. The second layer 22 can be provided to introduce or modify properties of the resulting knitted fabric 10, for example, to provide a desired thickness, elasticity and/or hand-feel, and/or to enhance durability, heat-retention, etc.

Preferably, the first knitted layer 12 of the knitted fabric 10 may further comprise one or more second yarns formed of or derived from recyclable materials. For example, the second yarns may form of materials derivable from recycled plastic materials. In one embodiment, the second yarns may comprise recycled or regenerated polymer fibres such as recycled polyester yarns. In one specific embodiment, the recycled polymer fibres comprise drawn-texturing yarns of 75 denier (D) with 72 strands of filament fibre (F) (75 D/72 F DTY). In one further embodiment, the second yarns may comprise composite or conjugate yarns comprising recycled polyester yarn such as 75 D/72 F DTY and spandex yarns such as spandex yarns of 30 denier (30 D OP).

Preferably, the first knitted layer 12 of the knitted fabric 10 may further comprise one or more third yarns comprising one or more of a polyester material, a nylon material, a spandex material and/or an acrylic material, although a person skilled in the art will appreciate that any other yarn materials such as other synthetic or natural polymeric yarns may also be encompassed by the present invention. In one embodiment, the third yarns may comprise polyester yarns such as low elastic polyester yarn such as 30 D/36 F and/or 75 D/72 F low elastic polyester yarns. The third yarns may also comprise spandex yarns such as 30 D OP.

In another aspect, the present invention provides a method of manufacturing the embodied antimicrobial knitted fabric 10. The method may comprise a step of weft knitting of one or more yarns comprising the silver metal-comprising first yarn according to a weft knitted pattern (STEP 1, FIG. 5). In one embodiment, the weft knitted pattern may comprise a first course comprising a tuck stitch, two float stitches, and a tuck stitch in sequence; a second course comprising two knit stitches and two float stitches in sequence; a third course comprising two float stitches and two knit stitches in sequence; a fourth course comprising a float stitch, two tuck stitches and one float stitch in sequence; a fifth course comprising two knit stitches and two float stitches in sequence; and a sixth course comprising two float stitches and two knit stitches in sequence. A schematic diagram showing an embodied knitted pattern is shown in FIG. 4, wherein a knit stitch is schematically represented by the symbol "“▯”" or "“▯”"; a tuck stitch is schematically represented by the symbol "∪" or "∩"; and a float stitch is schematically represented by the symbol "-". Preferably, the weft knitting step comprises repeating the knitted pattern for six (6) times to form a thirty-six (36) courses weft knitted pattern, although variation to the number of repeat or the resulting number of courses at the knitted pattern is understood to be also applicable.

More preferably, the method comprises weft-knitting of at least four yarns, namely, Yarn 1, Yarn 2, Yarn 3 and Yarn 4. In one embodiment, Course 1 will be knitted with Yarn 1; Course 2 will be knitted with Yarn 2; Course 3 will be knitted with Yarn 3; Course 4 will be knitted with Yarn 1; Course 5 will be knitted with Yarn 2; and Course 6 will be knitted with Yarn 4, according to the weft-knitted pattern as shown in FIG. 4.

In one preferred embodiment, the antimicrobial knitted fabric 10 may form of weft-knitting from one or more metallic material-comprising first yarns comprising 40 D silver-metal comprising yarns; and one or more third yarns comprising 30 D/36 F low elastic polyester yarns, 75 D/72 F low elastic polyester yarns and 30 D spandex yarns (30 D OP).

In another preferred embodiment, the antimicrobial knitted fabric 10 may form of weft-knitting one or more metallic material-comprising first yarns comprising one or more of 40 D silver-metal comprising yarns, and/or composite yarns comprising 40 D silver-metal comprising yarns and 30 D spandex yarns (30 D OP); and one or more second, recycled polymeric yarns comprising composite yarns of recycled polyester yarn (75 D/72 F DTY) and 30 D spandex yarns (30 D OP). More preferably, the weft-knitting method requires at least four yarns, namely, Yarn 1 being a first yarn comprising 40 D silver-metal comprising yarn; Yarn 2 being a second, recycled polymeric yarn comprising a composite yarn of recycled polyester yarn (75 D/72 F DTY) and 30 D spandex yarn (30 D OP); Yarn 3 being a second, recycled polymeric yarn comprising composite yarn of recycled polyester yarn (75 D/72 F DTY) and 30 D spandex yarn (30 D OP); and Yarn 4 being a composite yarn of 40 D silver-metal comprising yarn and 30 D spandex yarn (30 D OP). Course 1 of the fabric 10 will be knitted with Yarn 1; Course 2 will be knitted with Yarn 2; Course 3 will be knitted with Yarn 3; Course 4 will be knitted with Yarn 1; Course 5 will be knitted with Yarn 2; and Course 6 will be knitted with Yarn 4, according to the weft-knitted pattern as shown in FIG. 4

In one embodiment, the knitting in accordance to the present invention can be performed by any known knitting machine such as a weft-knitting machine. The weft-knitting machine may comprise a circular knitting machine or a flatbed knitting machine, and preferably, the weft-knitting is performed by a circular knitting machine.

Figure 5:
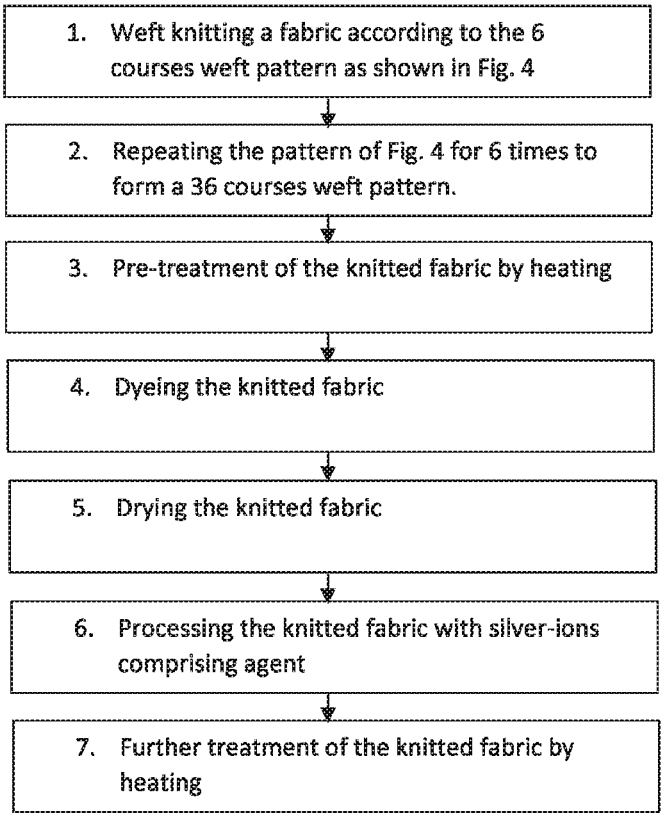
FIG. 5 shows an embodied method of manufacturing the antimicrobial knitted fabric according to the present invention.

Referring to FIG. 5, shown is a flow diagram illustrating the steps of manufacturing the embodied antimicrobial knitted fabric 10. After the weft-knitting step (STEP 1), the pattern is repeated for 6 times to form a 36-course weft-knitted pattern (STEP 2).

Prior to dyeing of the knitted fabric 10, the knitted fabric 10 is preferably processed under a pre-treatment step (STEP 3) conducted at a temperature of about 100° C. to about 250° C., and more preferably, at about 150° C. to about 200° C. The heating will be conducted at a speed of about 5 m/min to about 30 m/min, and preferably, at about 10 m/min to 25 m/min, in a pre-treatment machine with an overfeed ratio of about 10% to about 40%, and preferably, about 20% to about 30%.

Dyeing of the knitted fabric (STEP 4) is then conducted at a weight ratio of fabric to dye solution of about 1:10 to 8:10, and preferably, at a weight ratio of fabric to dye solution of about 3:10 to 7:10 under an elevated temperature of about 50° C. to about 150° C., and preferably, at about 80° C. to about 100° C. The dyeing step is conducted for about 30 min to about 90 min, and preferably, for about 60 min to 80 min. In one embodiment, the dye solution may comprise catechin of about 3% to about 5%, and sulfo-ρ-cyclodextrin of about 100 g/L to about 150 g/L, at a pH value of about 4 to about 6, and preferably, about pH 4. The dyed fabric will then be dried (STEP 5) at a temperature of about 80° C. to about 150° C., and preferably, at about 100° C. to about 130° C.

Optionally, the fabric after drying can be further processed with a silver-ions comprising agent to enhance the antimicrobial activity (STEP 6) of the fabric. This process can be conducted by, for example, immersing the fabric into a solution of the silver-ions comprising agent with a retention rate of about 60% to about 80%. Auxiliary agents be added to the solution for removing undesirable impurities and/or for enhancing adhesion of the silver ions to the fabric. Other auxiliary agents may also be used to provide an anti-fouling effect and/or to enhance the antimicrobial effect of the fabric. In one embodiment, the auxiliary agents may comprise sodium alkyl benzene sulfonate at a concentration of about 30 g/L to about 50 g/L, for example.

The fabric will then be further treated by heating (STEP 7) at a temperature of about 80° C. to about 150° C., preferably, at about 100° C. to about 130° C. at a speed of about 10 m/min to 30 m/min.

The present invention is applicable to the producing or manufacturing of any textile garments, apparels or wearable items such as face masks or face covers, gloves, trousers, hats, head-wears, shoes, shoe-linings, socks, sports-wears, under-garments, uniforms, as well as personal protective equipment. The present invention is also applicable to the producing or manufacturing of any household, furniture, or utility items such as bedsheets or bed coverings, blankets, sleeping bags, towels, window curtains, bathroom curtains, floor mats or covers, kitchen covers, table covers, chair covers, carrying bags, storage bags, travelling bags, umbrellas or the like. The fabric of the present invention protects the wearers or users from harmful contaminants due to the efficient antimicrobial activity of the silver metal-comprising first yarn at high surface area to volume ratio and at high content.

The present invention relates to a knitted fabric and particularly, but not exclusively, an antimicrobial knitted fabric capable of reducing, inhibiting growth of or eliminating harmful microorganisms such as, but are not limited to, bacteria, viruses and fungi, and at the same time, providing an improved comfortability and usability for the users. The antimicrobial knitted fabric, which is preferably manufactured by weft-knitting, comprises metallic silver-comprising yarns arranged to provide free-floating loop structures at the surface of a knitted layer of the fabric. The free-floating loop structures are beneficial in increasing surface area of the silver yarns at the fabric to thereby enhance the contact antimicrobial effect of the fabric against various microbes. The silver metal atoms of the metallic silver yarns can be oxidized to form silver ions which are known to possess powerful anti-microbial abilities. Particularly, the positively charged silver ions are electrostatically attracted to the negatively charged bacteria, interfering or altering structure of the bacterial DNA and thus inhibiting replication of the bacteria. Metallic silver has also been proven to exhibit inhibiting activity against a broad-spectrum of pathogens including bacteria, viruses, fungi or the like upon contact. The knitted fabric of the present invention is thus capable of protecting the user or wearer from external contaminants by its self-disinfecting, anti-viral and anti-microbial effects due to the high surface area to volume ratio of metallic silver yarns at high content. The antimicrobial efficiency can further be improved by increasing contact surface area of the silver yarns with the pathogens, such as by arranging the free-floating loop structures of the silver yarns at respective plurality of recesses comprising the silver yarns, and/or by forming protrusions comprising the silver yarns at the surface of the knitted layer. The resulting knitted fabric demonstrates highly effective antimicrobial effect and, at the same time, provides superior breathability, i.e. moisture vapor transmission, stretchability and hand-feel to the knitted material. It is demonstrated that the antimicrobial efficiency of the knitted fabric can be maintained after about 100-200 times of washing. The high content of silver yarns at the resulting fabric offers further benefits in facilitating heat conduction to help regulation of body temperature and in inhibiting undesirable odors caused by microbials. The free-floating loop structures of the silver yarns at recesses of the fabric layer and/or the silver yarns-comprising protrusions at the surface of the fabric layer may further be arranged in specific knit patterns to offer aesthetic, decorative features to the knitted fabric.

The present description illustrates the principles of the present invention. It will thus be appreciated that those skilled in the art will be able to devise various arrangements that, although not explicitly described or shown herein, embody the principles of the invention and are included within its spirit and scope.

Moreover, all statements herein reciting principles, aspects, and embodiments of the invention, as well as specific examples thereof, are intended to encompass both structural and functional equivalents thereof. Additionally, it is intended that such equivalents include both currently known equivalents as well as equivalents developed in the future, i.e., any elements developed that perform the same function, regardless of structure.

While the invention has been illustrated and described in detail in the drawings and foregoing description, the same is to be considered as illustrative and not restrictive in character, it being understood that only exemplary embodiments have been shown and described and do not limit the scope of the invention in any manner. It can be appreciated that any of the features described herein may be used with any embodiment. The illustrative embodiments are not exclusive of each other or of other embodiments not recited herein. Accordingly, the invention also provides embodiments that comprise combinations of one or more of the illustrative embodiments described above. Modifications and variations of the invention as herein set forth can be made without departing from the spirit and scope thereof, and, therefore, only such limitations should be imposed as are indicated by the appended claims.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

It is to be understood that, if any prior art publication is referred to herein, such reference does not constitute an admission that the publication forms a part of the common general knowledge in the art.

The invention claimed is:

1. A method of manufacturing an antimicrobial knitted fabric, the fabric comprises at least one first knitted layer having one or more first yarns comprising a metallic material, the first yarns are arranged to provide a plurality of free-floating loop structures at a surface of the first knitted layer thereby increasing surface area of the metallic material-comprising first yarns to enhance antimicrobial effect of the fabric; the method comprises a step of weft knitting of one or more yarns according to a weft knitted pattern comprising:

- a first course comprising a tuck stitch, two float stitches, and a tuck stitch in sequence;
- a second course comprising two knit stitches and two float stitches in sequence;
- a third course comprising two float stitches and two knit stitches in sequence;

a fourth course comprising a float stitch, two tuck stitches and one float stitch in sequence;

a fifth course comprising two knit stitches and two float stitches in sequence; and a sixth course comprising two float stitches and two knit stitches in sequence.

2. The method according to claim 1, wherein the weft knitting step comprises repeating the pattern for 6 times to form a 36 courses weft knitted pattern.

3. The method according to claim 1, further comprising a step of dyeing the knitted fabric after the weft knitting step, wherein the step of dyeing the knitted fabric is conducted at a weight ratio of fabric to dye solution of about 1:10 to 8:10; wherein the dyeing step is conducted at a temperature of about 50° C. to about 150° C. for about 30 min to about 90 min.

4. The method according to claim 3, wherein the dye solution comprises catechin of about 3 w/w % to about 5 w/w %, and sulfo-ρ-cyclodextrin of about 100 g/L to about 150 g/L; wherein the dye solution is of a pH value of about 4 to about 6.

5. The method according to claim 3, further comprising a pre-treatment processing step of the knitted fabric prior to the dyeing step, wherein the pre-treatment processing step is conducted at a temperature of about 100° C. to about 250° C.; wherein the pre-treatment processing step comprises treating the fabric at a speed of about 5 m/min to about 30 m/min with an overfeed ratio of about 10% to about 40%.

6. The method according to claim 3, further comprising a drying step after the dyeing step, wherein the drying step is conducted at a temperature of about 80° C. to about 150° C.

7. The method according to claim 6, further comprising a step of processing the fabric with a silver-ions comprising agent after the drying step; wherein the processing step is conducted by immersing the fabric into a solution of the silver-ions comprising agent.

8. The method according to claim 6, further comprising a further treatment step by heating the fabric at a temperature of about 80° C. to about 150° C.

9. The method according to claim 1, wherein the at least one first knitted layer of the antimicrobial knitted fabric comprises a plurality of recesses arranged to accommodate the plurality of loop structures; wherein each of the plurality of recesses is arranged to accommodate respective one of the plurality of loop structures.

10. The method according to claim 9, wherein the at least one first knitted layer of the antimicrobial knitted fabric comprises a plurality of protrusions extending away from one or more planar regions of the first knitted layer, one or more of the plurality of protrusions comprises the metallic material-comprising first yarns.

11. The method according to claim 10, wherein the plurality of recesses and the plurality of protrusions are alternately arranged at the first knitted layer.

12. The method according to claim 11, wherein the at least one first knitted layer comprises two first knitted layers oppositely arranged in an interlocked arrangement, with the plurality of recesses of each first knitted layer facing away from one another; wherein the plurality of recesses of the two first knitted layers are aligned.

13. The method according to claim 12, wherein the two first knitted layers are connected via a middle, second layer; wherein the second layer is a second knitted layer.

14. The method according to claim 1, wherein the metallic material of the first yarns comprises silver metal, wherein the first knitted layer comprises a content of silver metal at about 5 w/w % to about 50 w/w %.

15. The method according to claim 1, wherein about 50% to about 70% of the surface area of the first knitted layer comprises the loop structures of the first yarns.

16. The method according to claim 1, wherein the first yarn comprises at least one of a metallic silver coating on a core fibre and/or a metallic silver incorporated polymeric material.

17. The method according to claim 1, wherein the first knitted layer comprises one or more second yarns formed of or derivable from recyclable materials; wherein the recyclable materials comprise recycled plastic materials.

18. The method according to claim 1, wherein the first knitted layer comprises one or more third yarns comprising one or more of a polyester material, nylon material, spandex material and/or acrylic material.

* * * * *